US005709641A

United States Patent [19]

Vaquero

[11] Patent Number: 5,709,641

[45] **Date of Patent: *Jan. 20, 1998**

[54] THERMOPLASTIC BAG STRUCTURE

[75] Inventor: Edward A. Vaquero, Fairport, N.Y.

[73] Assignee: Tenneco Packaging Inc., Evanston, Ill.

[ * ] Notice: The term of this patent shall not extend beyond the expiration date of Pat. No. 5,683,340.

[21] Appl. No.: 624,817

[22] Filed: Mar. 26, 1996

[51] Int. Cl.[6] ..... B31B 27/00

[52] U.S. Cl. ..... 493/243; 493/195; 493/231; 493/243; 493/405

[58] Field of Search ..... 206/554; 383/37, 383/27; 493/405, 410, 413, 193–197, 199, 198, 230, 231, 238, 243, 244, 246, 255, 262, 263, 267, 268

[56] References Cited

U.S. PATENT DOCUMENTS

| | | | |
|---|---|---|---|
| 144,238 | 11/1873 | Stow . | |
| 2,822,012 | 2/1958 | Gold | 150/10 |
| 3,607,521 | 9/1971 | Suominen . | |
| 4,368,051 | 1/1983 | Lehmacher | 493/11 |
| 4,410,130 | 10/1983 | Herrington | 383/62 |
| 4,445,230 | 4/1984 | Spadaro | 383/7 |
| 4,562,925 | 1/1986 | Pistner . | |
| 4,571,235 | 2/1986 | Benoit | 493/195 |
| 4,583,642 | 4/1986 | Bythe et al. | 206/390 |
| 4,597,494 | 7/1986 | Benoit | 206/390 |
| 4,609,366 | 9/1986 | Ley | 493/22 |
| 4,652,253 | 3/1987 | Benoit | 493/195 |
| 4,655,737 | 4/1987 | Benoit | 493/194 |
| 4,699,608 | 10/1987 | Pistner | 493/204 |
| 4,764,029 | 8/1988 | Abblett | 383/104 |
| 4,786,275 | 11/1988 | Hoover | 493/194 |
| 4,790,437 | 12/1988 | Pistner . | |
| 4,807,754 | 2/1989 | Rowe | 206/390 |
| 4,811,418 | 3/1989 | Reifenhauser | 206/554 |
| 4,816,104 | 3/1989 | Benoit | 156/204 |
| 4,819,806 | 4/1989 | Pistner | 206/554 |
| 4,840,610 | 6/1989 | Pistner | 493/194 |
| 4,849,090 | 7/1989 | Case | 206/390 |
| 4,890,736 | 1/1990 | Greyvenstein | 206/390 |
| 4,904,092 | 2/1990 | Campbell et al. | 383/35 |
| 4,911,561 | 3/1990 | Wagner | 206/554 |
| 4,931,033 | 6/1990 | Leeds | 493/195 |
| 4,931,034 | 6/1990 | Wagner | 493/203 |
| 5,215,275 | 6/1993 | Gold | 493/238 |
| 5,246,110 | 9/1993 | Greyvenstein | 206/390 |
| 5,290,104 | 3/1994 | Sengewald | 206/554 |
| 5,573,489 | 11/1996 | Letendre | 493/194 |

FOREIGN PATENT DOCUMENTS

| | | |
|---|---|---|
| 2120901 | 12/1994 | Canada . |
| 2126414 | 12/1994 | Canada . |
| 1822842 | 6/1993 | U.S.S.R. . |

*Primary Examiner*—Joseph J. Hail, III
*Assistant Examiner*—Christopher W. Day
*Attorney, Agent, or Firm*—Arnold, White & Durkee

[57] ABSTRACT

A thermoplastic bag structure and method for making and packaging thermoplastic bags such that their tops are easily identified and the bags are easily opened. The method for producing these bags begins with cutting a flattened thermoplastic tube into two portions. At least one of the two portions is then collapsed to form a sheet of material having a pair of thermoplastic layers, a straight folded bottom edge and a pair of top edges, at least one of which has a skewed-cut. Bag side structures are formed in the sheet of material at about bag-width distances apart. The bags are then folded a predetermined number of times, in a direction transverse to the bag side structures, so that the skewed-cut top edge(s) of each of the bags remains exposed.

1 Claim, 4 Drawing Sheets

THERMOPLASTIC BAG STRUCTURE

FIELD OF THE INVENTION

The present invention generally relates to thermoplastic bags and, more particularly, is concerned with a thermoplastic bag structure and method for making the thermoplastic bag structure with easily identifiable tops that are easy to open.

BACKGROUND OF THE INVENTION

For many years, thermoplastic bags have been widely used for a number of household and industrial purposes. Many have a simple rectangular structure comprising two layers of thermoplastic film, heat sealed sides, a folded bottom and an open top. This simple structure has been adapted to form a wide variety of sizes and configurations that vary with the intended uses of the bags.

In recent years, bag manufacturers have developed new ways of packaging bags. One method of packaging bags involves winding perforated, interconnected bags into a roll. The consumer then unrolls a bag, tears it off of the roll and opens it. Another method of packaging bags involves the packaging of separate, individually folded bags into a stack. The consumer then selects a bag, unfolds it and opens it. Advances in the thermoplastic bag art have produced very thin, yet strong, bags. Furthermore, advances in perforation technology have produced interconnected bags that can be cleanly separated from a roll of bags.

However, these advances do have disadvantages. The thin layers and clean edges make it difficult to distinguish the top of the bag from the bottom, or even the sides, of the bag. This often frustrates consumers who must struggle to find the top of the bag to open it. Once the top is found, the thin layers also make it difficult to open the bags.

Consequently, these deficiencies have created a need for bags with tops that are easily identified and easily opened.

SUMMARY OF THE INVENTION

The present invention provides a thermoplastic bag structure and method for making and packaging thermoplastic bags such that their tops are easily identified and the bags are easily opened. The method for producing these bags begins with cutting a flattened thermoplastic tube into two portions. At least one of the two portions is then collapsed to form a sheet of material having a pair of thermoplastic layers, a straight folded bottom edge and a pair of top edges, at least one of which has a skewed-cut. Bag side structures are formed in the sheet of material at about bag-width distances apart. The bags are then folded a predetermined number of times, in a direction transverse to the bag side structures, so that the skewed-cut top edge(s) of each of the bags remains exposed.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
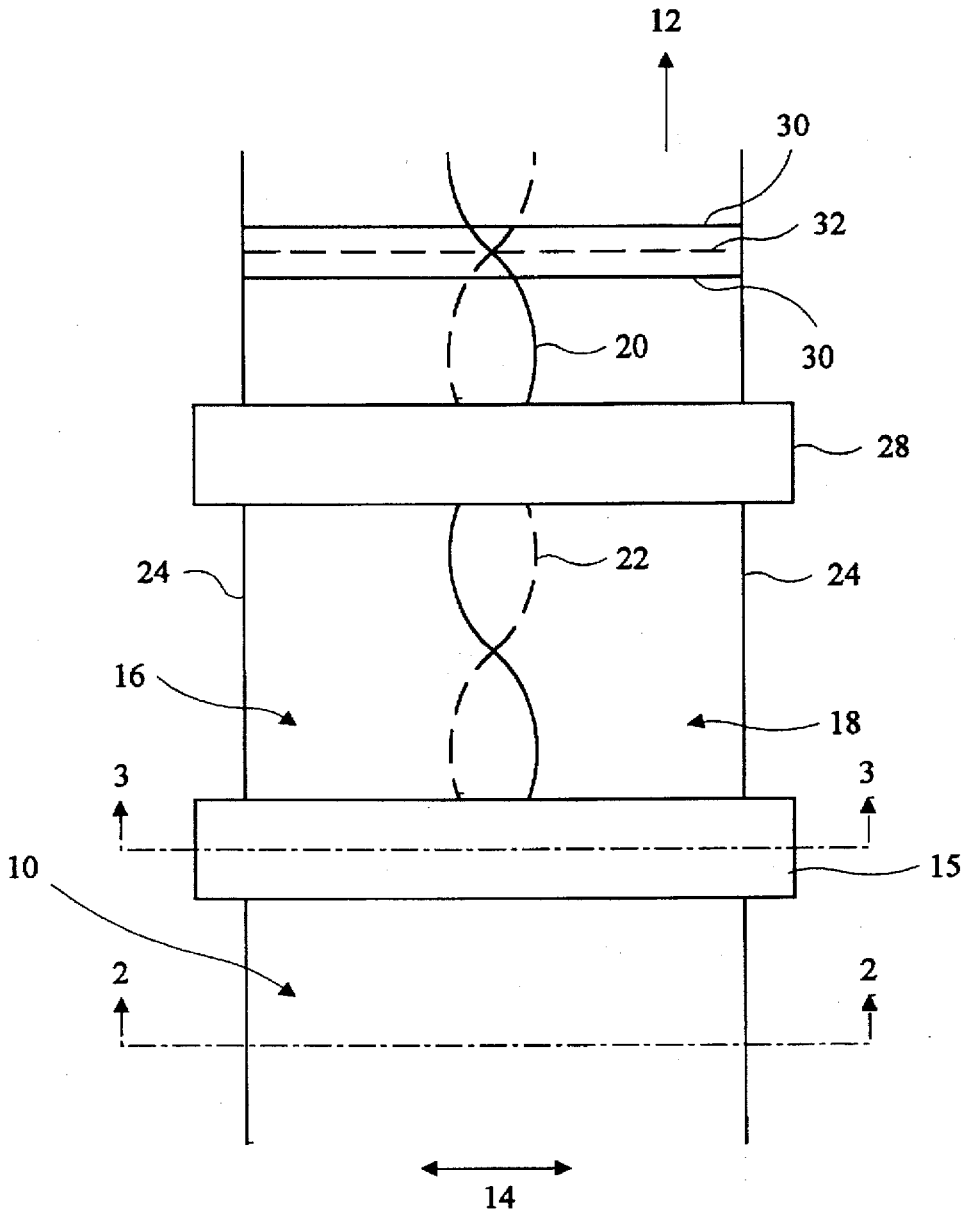
FIG. 1 is a top plan view of a flattened thermoplastic tube being processed into a plurality of interconnected bags.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DETAILED DESCRIPTION OF THE PREFERRED EMBODIMENT

Referring now to the drawings, and more particularly to FIG. 1, there is shown a flattened thermoplastic tube 10 traveling in a longitudinal direction 12. The transverse direction 14 is generally perpendicular to the longitudinal direction 12 in which the thermoplastic tube 10 moves. The thermoplastic material used can be any thermoplastic material well known to one of ordinary skill in the art and as more specifically detailed herein below. A cutting station 15 includes two independent cutting instruments (not shown in FIG. 1) that operate from opposite sides of the tube 10 to sever the tube 10 into portions 16 and 18. Each cutting instrument oscillates in the transverse direction 14 as the tube moves in the longitudinal direction 12. The sinusoidal path produced by the top cutting instrument is shown as a solid line 20 and the sinusoidal path produced by the bottom curing instrument is shown as a dashed line 22. These two paths will form the sinusoidal-cut top edges of the bags.

The oscillation of the cutting instruments preferably takes place about the centerline of the tube 10. However, the cutting instruments may be offset to either side of the centerline of the tube 10 to create portions 16 and 18 in different sizes. This could facilitate the production of two different size bags at the same time.

Preferably, both of the cutting instruments oscillate 180 degrees out of phase with each other. This produces sinusoidal-cut top edges 26 and 27 (see FIG. 5) that are easily identifiable and separable from each other. However, the tube 10 may be severed with one cutting instrument producing in phase sinusoidal-cut top edges. Moreover, varying styles of skewed-cut top edges are alternatively available. For example, truncated cone shaped, sawtooth shaped, diamond shaped or any phase shifted, varying amplitude sinusoidal shaped top edges may be used interchangeably to gain the same advantages described herein.

Figure 5:
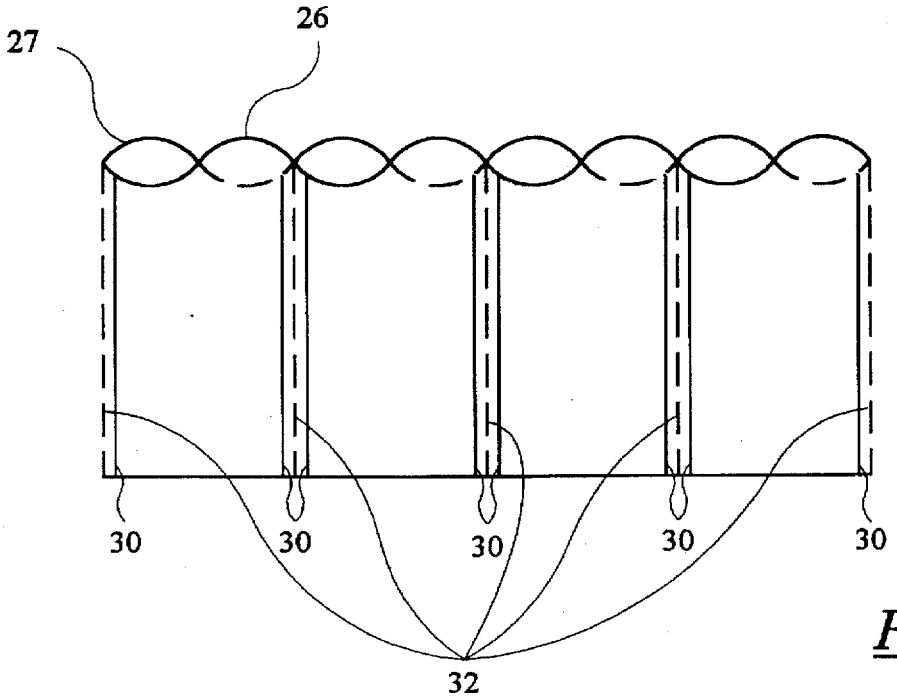
FIG. 5 is a top plan view of one of the portions of the collapsed thermoplastic tube showing perforations and heat seals.

After leaving the cutting station 15, the tube portions 16 and 18 are then collapsed to form two continuous sheets of material each having, when laid flat, a pair of thermoplastic layers (not shown in FIG. 1), a straight folded bottom edge 24, the sinusoidal-cut top edge 26 extending from one layer, and the sinusoidal-cut top edge 27 extending from the other layer (see FIG. 5).

After the pair of layers has been severed, the collapsed tube portions 16 and 18 travel through a sealing station 28 where pairs of closely located transverse heat seals 30 are formed across the tube portions 16 and 18 at about bag-width distances apart. The pair of thermoplastic layers of each tube portion are thermally fused to each other along the heat seals 30. The transverse heat seals 30 intersect with the points of minimum deflection of the sinusoidal-cut top edges 26 and 27. This produces one sinusoidal period per bag. In this preferred configuration, the two layers are either in phase or out of phase with each other. Alternatively, one broad heat seal may replace each pair of closely located heat seals 30. This broad heat seal may then either be perforated or severed to produce the same results described herein.

Either simultaneously with the heat sealing or afterwards in a separate step, a transverse perforation 32 is created between each pair of closely located heat seals 30 to form separable bags. Alternatively, the sheets of material may be severed between the closely located heat seals 30 so as to form individual bags. In either embodiment, when the bags are laid flat, each bag comprises a pair of opposing heat seals 30, a segment of the straight folded bottom edge 24, a period of the sinusoidal-cut top edge 26 extending from one layer, and a period of the sinusoidal-cut top edge 27 extending from the other layer (see FIG. 5).

Figure 2:
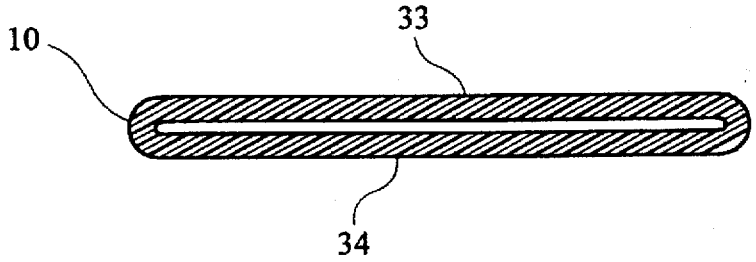
FIG. 2 is a cross-sectional view of the flattened thermoplastic tube taken generally alone line 2—2 in FIG. 1.
Figure 4:
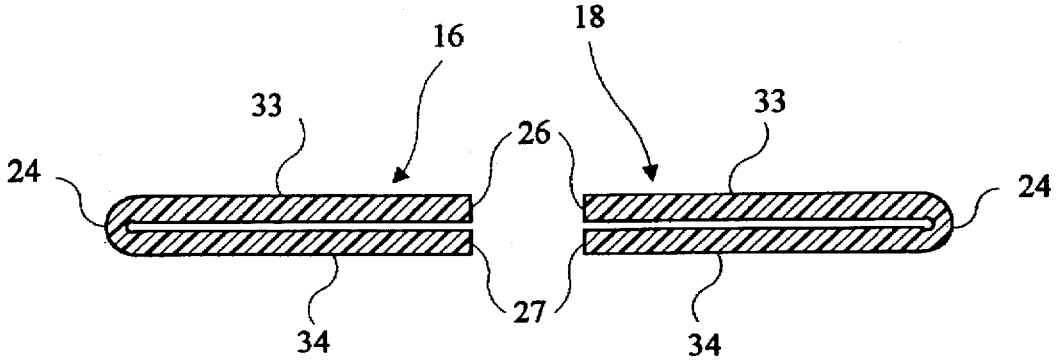
FIG. 4 is a cross-sectional view of the thermoplastic tube after it has been collapsed and severed into two portions.

The flattened thermoplastic tube 10 is shown by a cross-sectional view in FIG. 2 prior to the tube being severed into the two portions 16 and 18 (see FIG. 4). The top thermoplastic layer 33 opposes the bottom thermoplastic layer 34.

Figure 3:
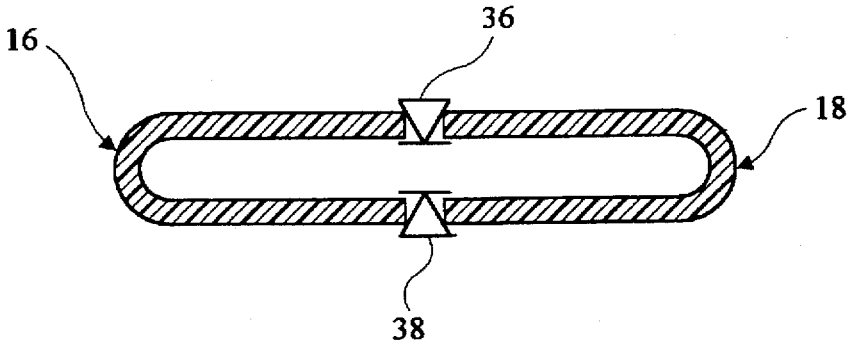
FIG. 3 is a cross-sectional view of the flattened thermoplastic tube taken generally alone line 3—3 in FIG. 1.

The flattened thermoplastic tube 10 is depicted by a cross-sectional view in FIG. 3 being severed by the cutting instruments 36 and 38. This separates the tube 10 into the two portions 16 and 18.

The two tube portions 16 and 18 are shown by a cross-sectional view in FIG. 4 after being separated and collapsed. Each portion comprises the pair of thermoplastic layers 33 and 34, the straight folded bottom edge 24, and the sinusoidal-cut top edges 26 and 27.

One of the tube portions, either 16 or 18, is shown in FIG. 5 in its collapsed state. FIG. 5 shows the sinusoidal-cut top edge 26 extending from one layer, the sinusoidal-cut top edge 27 (shown partially in phantom) extending from the other layer, the pairs of closely located heat seals 30, and the perforations 32 between each pair of heat seals 30.

Figure 6:
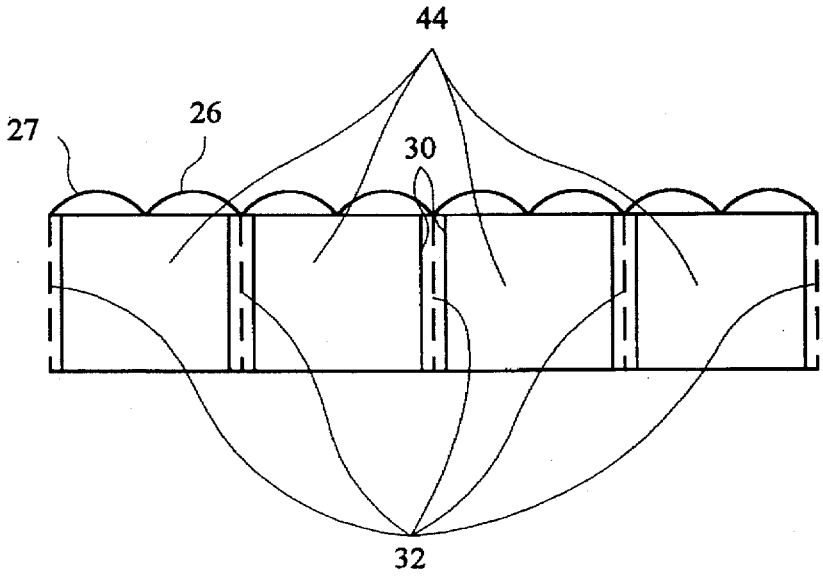
FIG. 6 is a top plan view of one of the portions of the collapsed thermoplastic tube, after it has been folded, showing the perforations, the heat seals, and exposed skewed-cut top edges.
Figure 7A:
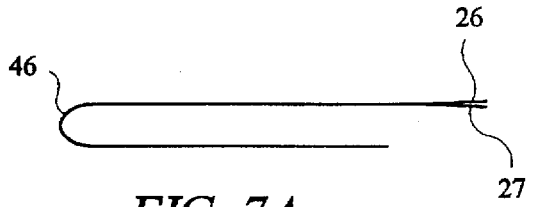
FIG. 7(*a*)–(*l*) is an elevational side view of various folding patterns, all of which expose the skewed-cut top edges.
Figure 7B:
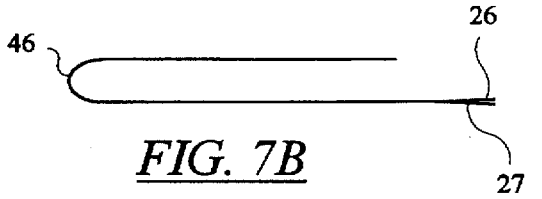
Figure 7C:
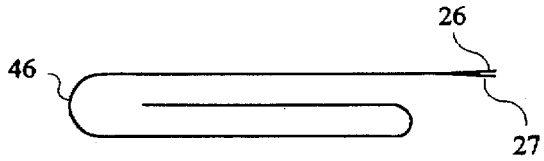
Figure 7D:
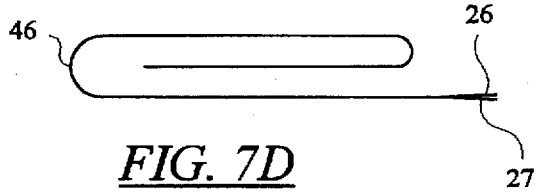
Figure 7E:
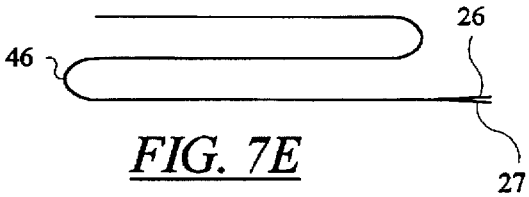
Figure 7F:
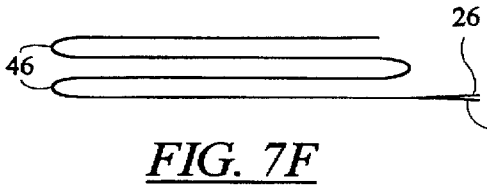
Figure 7G:
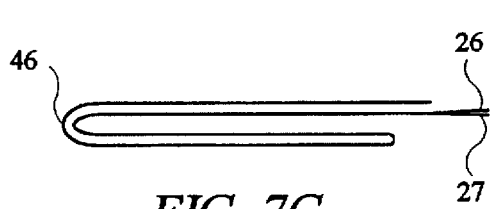
Figure 7H:
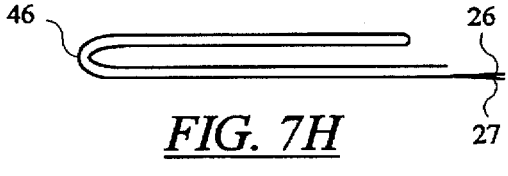
Figure 7I:
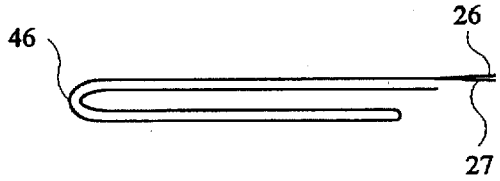
Figure 7J:
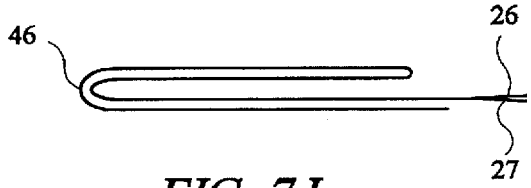
Figure 7K:
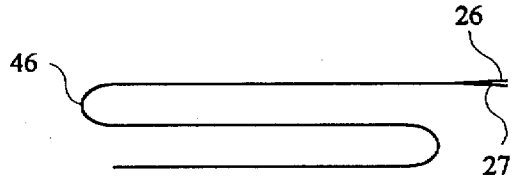
Figure 7L:
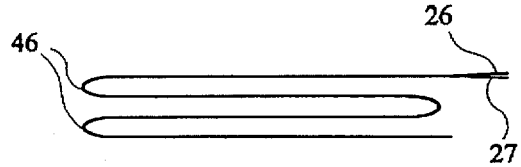

One of the tube portions, either 16 or 18, is also depicted in FIG. 6 where the interconnected bags 44 are shown in their collapsed and folded state. Adjacent bags share a perforation 32. In addition, each bag has a segment of the straight folded bottom edge 24, a period of the sinusoidal-cut top edge 26 extending from one layer, a period of the sinusoidal-cut top edge 27 extending from the other layer, and a pair of opposing heat seals 30.

Various depictions of folding patterns are shown in FIG. 7. In each pattern, the bag is folded 180 degrees in various directions a various number of times. In each case, the resulting folded bag comprises top edges 26 and 27 that extend over the folded bag structure 46. These folding patterns are merely illustrative and are not intended to limit the scope of the present invention. For example, if the bags are separated iota each other and then folded individually, folds can be imparted to each bag in both the longitudinal and transverse directions so long as at least one of the skewed-cut top edges 26 and 27 remains exposed.

After the interconnected bags 44 have been heat sealed, perforated, and folded, with top edges extending over the bag structure, the bags may then be wound into rolls for packaging. Alternatively, if the bags were severed into individual bags, and folded, with top edges extending over the bag structure, the side edges of the bags may be overlapped and then wound into rolls for packaging. In yet another embodiment of the invention, the bags are severed into individual bags, and folded, with top edges extending over the bag structure, and are then simply stacked for packaging. In either of the above two embodiments, the bags may either be severed and then folded, or folded and then severed.

A consumer desiring to locate and open a bag produced and packaged by the above described process can easily identify the top of the bag, whether it was in rolled form or stacked form, because the top edges extend over the folded bag structure. Next, if the bags are packaged in roll form, the consumer separates the outer-most bag on the roll along the side perforation. Then the consumer grasps the pair of opposing sinusoidal-cut top edges 26 and 27 and pulls them apart in opposite directions to separate the first layer from the second layer, thus opening the bag easily.

The thermoplastic materials suitable for the present invention include high density and low density polyethylenes. Particularly preferred is linear low density polyethylene (LLDPE). LLDPE is an ethylenic copolymer formed by copolymerizing ethylene with a minor proportion by weight of an alpha olefin monomer containing 4 to 10 carbon atoms. The use of LLDPE in garbage bags has permitted manufacturers to increase strength, puncture resistance, and tear resistance properties. By way of example, and not intended to limit the scope of the present invention, typical film thicknesses used for bags of the present invention are from about 0.3 mil to about 1.5 mil.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method for making and folding a web of interconnected thermoplastic bags, the method comprising the steps of:

a. supplying a flattened tube of thermoplastic film traveling along a longitudinal direction parallel to an axis of said tube, said flattened tube having opposing top and bottom sides;

b. cutting respective top and bottom sides of said flattened thermoplastic film tube into two halves by separately cutting the top and bottom sides along associated substantially non-superposed cutting paths such that each of said halves includes a top layer, a bottom layer, a straight-folded longitudinal edge joining said top and bottom layers, said top and bottom layers of each of said halves including respective mouth edges opposing said straight-folded longitudinal edge, wherein at least one of the mouth edges is skewed-cut such that respective non-overlapping portions of said mouth edges of said top and bottom layers are formed when the top and bottom sides of the flattened tube are collapsed on one another;

c. forming transverse bag heat seals at bag-width distances apart in said flattened thermoplastic film tube to form said web of interconnected thermoplastic bags; and d. folding said plurality of interconnected bags along a respective fold line parallel to said longitudinal direction a predetermined number of times such that said respective non-overlapping portions of said mouth edges remain at least partially exposed.

* * * * *